United States Patent [19]

Instone

[11] 4,113,334

[45] Sep. 12, 1978

[54] ELECTRICAL OUTLET STRIP

[75] Inventor: John C. Instone, Cherry Hill, N.J.

[73] Assignee: SGL Industries, Inc., Haddonfield, N.J.

[21] Appl. No.: 817,849

[22] Filed: Jul. 21, 1977

[51] Int. Cl.[2] ..... H01R 9/00

[52] U.S. Cl. ..... 339/22 R; 29/628; 339/128

[58] Field of Search ..... 339/20, 21, 22, 23, 339/128, 276 R; 29/626, 628

[56] References Cited

U.S. PATENT DOCUMENTS

| | | | |
|---|---|---|---|
| 2,088,845 | 8/1937 | DeMask | 339/22 R |
| 2,313,960 | 3/1943 | O'Brien | 339/22 R |
| 2,370,725 | 3/1945 | Gordon | 339/276 R |
| 3,263,131 | 7/1966 | Rowe | 339/22 B |
| 3,310,773 | 3/1967 | Baenziger et al. | 339/276 R |
| 3,596,233 | 7/1971 | DeVito | 339/128 |

FOREIGN PATENT DOCUMENTS

| | | | |
|---|---|---|---|
| 1,506,222 | 11/1967 | France | 339/128 |

OTHER PUBLICATIONS

Product Engineering Design Manual, Electrical Terminal Connections, p. 242, 1959.

*Primary Examiner*—Neil Abrams
*Attorney, Agent, or Firm*—Cushman, Darby & Cushman

[57] ABSTRACT

An electrical outlet strip comprises a casing having a plurality of special snap-in outlet receptacles disposed in openings in one wall of the casing. The outlet receptacles have specially slotted hot, neutral and ground terminals disposed within the casing in a preselected arrangement such that during assembly of the strip bus wires can be rapidly connected between the corresponding terminals of the receptacles by placing the bus wires in the slots and subsequently crimping the terminals and/or soldering the bus wires to the terminals.

11 Claims, 5 Drawing Figures

ELECTRICAL OUTLET STRIP

This invention relates to cased electrical components such as electrical outlet strips having snap-in receptacles supported in apertures in a casing, the receptacles having terminals for connection to the electrical wiring that provide a means for use in an assmelby making possible a new method for fabricating the components.

BACKGROUND

An electrical outlet strip typically includes a case stamped from sheet metal in the form of a base and a cover which together define a box-like space. One or more electrical outlet receptacles, typically five or more, are disposed in individual apertures in the top face of the cover, the receptacles usually being held in the apertures by resilient snap-in members carried by the receptacles in a manner to engage the peripheries of the apertures. The front faces of the receptacles are exposed at the locations of the apertures and are provided with the usual holes for receiving the prongs of an electrical plug. Typically there are three holes, two for receiving the power prongs of the plug and the third for receiving a ground prong regardless of whether the plug includes a ground prong.

In the past the outlet receptacles which have been used in making outlet strips have been conventional snap-in receptacles of the kind employed in major household appliances such as stoves and ovens, where it was desired to provide the user with one or two outlets for operating smaller appliances such as electric mixers, electric coffee makers or electric knives. A conventional receptacle of this kind typically comprises, in addition to the snap-in feature, an electrically insulating body having two fixed metal terminals (live and neutral) on its rear face, that is on the face opposite the prong-receiving face. A ground connection is also provided in the form of either a third fixed terminal or a flexible insulated pig-tail. When such receptacles are snapped into the apertures in an outlet strip the terminals and the ground connection are readily accessible through the opening in the casing formed when the base is not in place. One of the steps in the assembly of the final outlet strip is to manually connect the live and neutral terminals in parallel inside the casing and to connect all of the ground connections to the casing. In the conventional appliance-type receptacle the live and neutral terminals are simple rectangular tabs, sometimes with a hole therethrough and sometimes without a hole. This kind of live and neutral terminal arrangement is quite satisfactory when one or two receptacles are to be connected into a major appliance. But when making outlet strips where five or more receptacles are fitted into a single small casing the wiring of the receptacles in parallel became quite time consuming. Several techniques were developed, usually including the use of two bus wires, one connected to all the live terminals and the other connected to all the neutral terminals, by threading, interlacing, wrapping or soldering or some combination of these. The techniques produced satisfactory results, but as requirements for heavier bus wire and for mechanical security prior to soldering came into effect the labor costs for these techniques increased. The individual wiring of each of the five or more ground connections, whether tab-type or pig-tail, to the casing also resulted in high labor costs.

BRIEF DESCRIPTION OF THIS INVENTION

This invention may make use of the conventional casing for supporting the series of insulated outlet receptacles that are all connected into a parallel circuit within the component, but the outlet receptacles are provided with specially shaped terminal elements that are disposed in a novel aligned pattern within the interior space within the casing. These special receptacles, which are themselves novel, make it possible to simplify the assembly steps required for completing an outlet strip efficiently with the required materials and resulting electrical characteristics to meet present UL specifications.

Each of the special snap-in outlet receptacles includes: an electrically insulating body having a flat front face provided with three apertures for receiving three prongs of an electrical plug, the body also having a rear face spaced from and generally parallel to the front face and having side walls between said front and rear faces; at least one resilient snap-in member carried by the receptacle body and protruding from a side wall thereof, the resilient member being resiliently displaceable in a direction generally parallel to the front face so as to be capable of releasably holding the receptacle within an aperture in an electrical component; three electrically conducting terminals having free end portions protruding from the rear face of the body and arranged at the apexes of an imaginary triangle, the end portions defining quick-connect, wire-receiving, open-end slots arranged such that a bus wire laid in each slot lies parallel to and spaced from the two other slots and parallel to and spaced from the rear face of the body.

In the preferred embodiment each of the terminals is formed from a metal strip having a width dimension substantially greater than its thickness dimension, two of the strips having their width dimensions disposed in different parallel planes and the other strip having its width dimension disposed in a plane transverse to the parallel planes, each of said two strips having a tongue pressed threfrom so as to define the respective slot between the tongue and the remainder of the strip and said other strip having a cut-out through the thickness dimension so as to define the slot in the other strip.

The terminals are mounted on the bodies of their respective receptacles in such a relationship that when the receptacles are snapped into place, and all of the live terminals will be spaced from and lie along one wall of the casing, the neutral terminals will be spaced from and lie along on opposite wall thereof, and all of the ground terminals will be positioned in a line extending about midway between the live and neutral terminals.

Imaginary planes engaging the inside surfaces of the extending arms at the ends of each of the terminals should lie in positions such that the planes are substantially parallel ro each other, and to the walls along which the live and neutral terminals lie.

It should be noted particularly, that with this above described disposition of the arms of the shaped terminals, the assembly of the bus wires to complete the parallel connection of the sets of terminals of the respective receptacles into an electrical circuit is facilitated. After the receptacles have all been snapped into place in their respective apertures in the casing, the live terminals are all disposed along one wall with the open arms of those terminals facing the open side of the casing. Similarly, the open arms of the neutral terminals face toward the open side along an opposite wall, and the ground terminals have open arms that are likewise disposed to face the open side of the casing, the ground terminals being positioned between the live and neutral terminals. When all of the receptacles are snapped into their respective apertures in the casing and the open arms of all of the shaped terminals are arranged in parallel planes as above described, all of the terminals are fixedly set in a predetermined pattern so that individual preshaped bus wires can be easily aligned with and fitted between the open arms of the several sets of terminals. After the properly selected, preshaped bus wires have been dropped in place between the arms of the respective shaped terminals, it is a simple matter to crimp or solder, or crimp and solder the wires and terminals together to complete the parallel circuit. Then the open side of the casing can be closed with a suitable cover.

IN THE DRAWINGS

DETAILED DESCRIPTION

Figure 1:
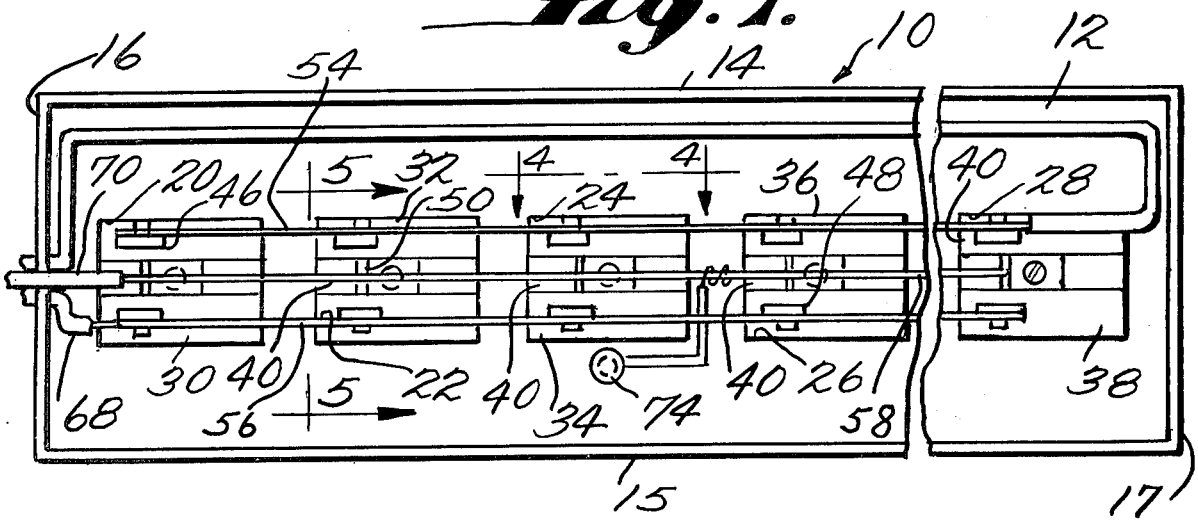
FIG. 1 is a plan view looking at the open side of a casing for an electrical output strip, with the cover removed, showing an in-line arrangement of receptacles in a casing.

The electrical outlet strip includes a casing 10 formed with a bottom 12, side walls 14 and 15 and end walls 16 and 17. These walls enclose a space within the casing having an open side opposite the bottom and a removable cover (not shown) that may be provided for closing the casing during use.

The bottom of the casing of this invention is provided with one or more and usually at least five apertures 20, 22, 24, 26 and 28 for receiving electrical outlet receptacles 30, 32, 34, 36 and 38. The receptacles have bodies with a cross-section to fit into and substantially fill their respective apertures. To hold the bodies firmly seated in the aperture a resilient member such as a metallic spring 40 is provided on each receptacle, the spring including two projecting latches 42 and 44 that extend beyond the sides of each of the receptacle bodies for resiliently engaging the casing body. The receptacles are held in place by the latches 42, 44, in conventional manner, such as shown in U.S. Pat. No. 3,596,233.

Figure 2:
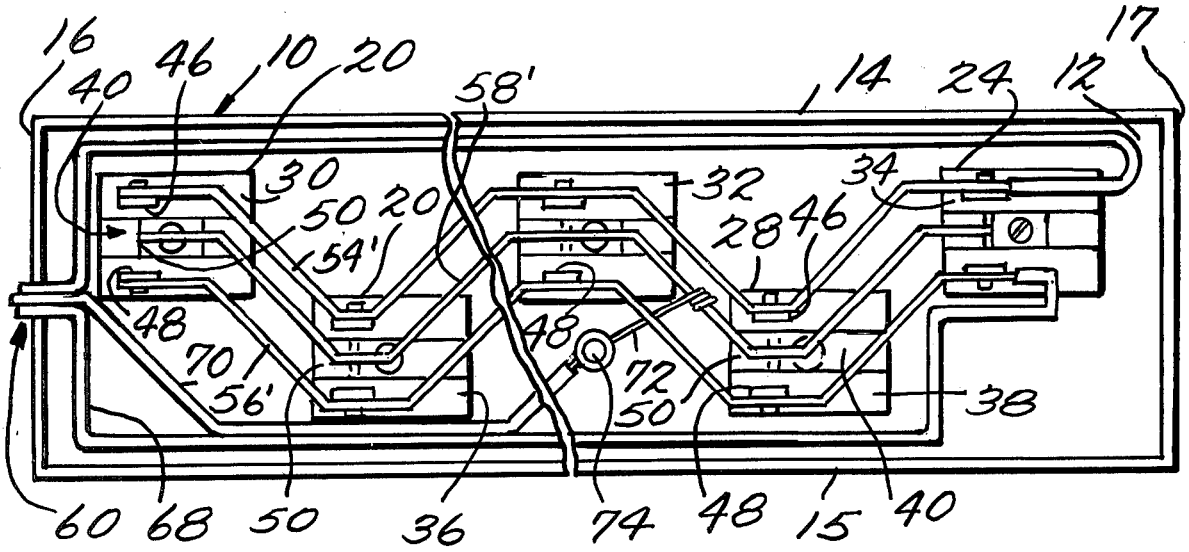
FIG. 2 is a plan view looking at the open side of the casing, with the cover removed, showing the receptacles in a staggered arrangement.

The apertures in the casing for receiving the receptacles may be arranged in a straight line as shown in FIG. 1 or may be staggered as shown in FIG. 2. Except for the alignment of the receptacles of FIGS. 1 and 2, the structures may be the same although different ground hook-ups are shown in the circuits illustrated as will appear more fully below.

Each receptacle has three apertures formed in its face that is exposed to the outside of the casing, which apertures are of a conventional pattern so that when the receptacles are seated in the casing 10, the prongs of a connector plug can be plugged into a receptacle.

Figure 3:
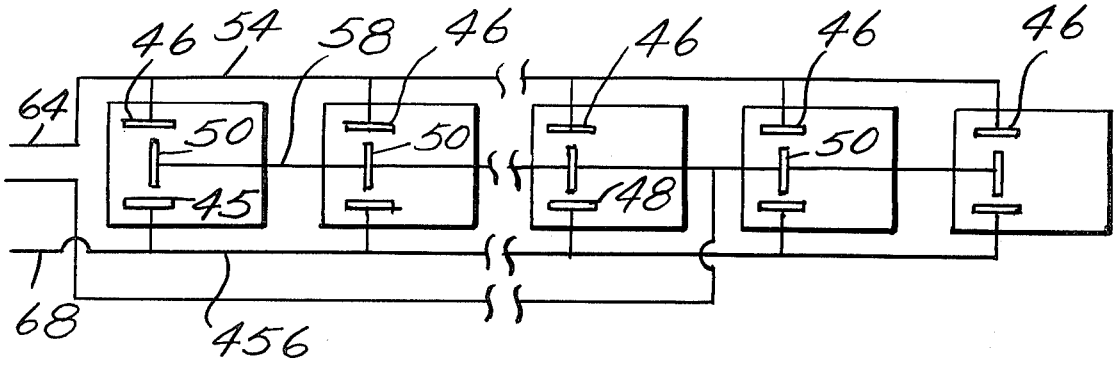
FIG. 3 is a diagrammatic view of the parallel electrical circuit for either FIG. 1 or FIG. 2.

The three apertures in each receptacle are disposed in line respectively with terminal elements 46, 48 and 50 that are supported in the insulating receptacle bodies 30, 32, 34, 36 and 38. The terminals project from the bodies into the internal space in the casing when the bodies have been fitted into their respective apertures 20, 22, 24, 26 and 28. The respective sets of live, neutral and ground terminals are adapted to be connected to separate bus wires to complete the circuit diagrammatically shown in FIG. 3. The receptacles are mounted in their respective apertures in the casing so that all of the live terminals 46 of the several receptacles 30, 32, 34, 36 and 38 are spaced from and lie along the side wall 14 of the body of the casing, all of the neutral terminals 48 are spaced from and lie along the side wall 15 of the casing and all the ground terminals 50 extend into the internal space within the casing and are positioned approximately midway between the terminals 46 and 48.

Figure 4:
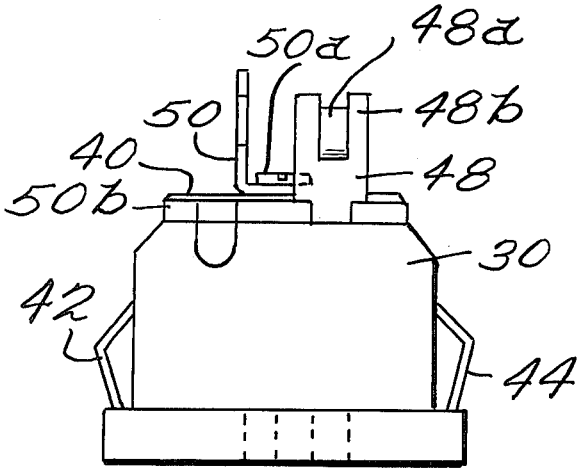
FIG. 4 is a side elevation of a snap-in receptacle of this invention.
Figure 5:
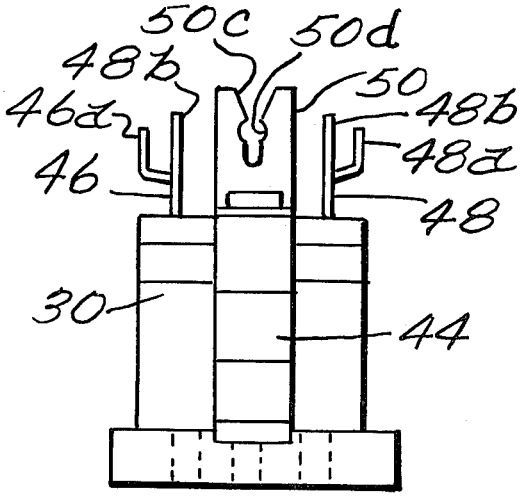
FIG. 5 is an end view of the receptacle shown in FIG. 4.

The terminals 46 and 48, as best seen in FIGS. 4 and 5, are preferably stamped from a metal strip are are supported in the bodies in a manner to make contact with the live and neutral prongs of a connector plug carried at the end of an electrical cord when the prongs are pushed into the receptacle. Similarly, the ground terminal 50 is designed to make contact with a ground prong, if any, of the plug, The other ends of these terminals that project into the internal space within the casing all have a shaped configuration with spread apart arms to receive respective bus wires. Terminals 46 and 48 may be, and preferably are, formed by making two slits in the end of the stamping from which the terminal is formed, to make three tongues that are shaped in a die stamping operation to separate the central tongue from the other two to produce a roughly Y-shaped terminal. The shape of these terminals is shown in FIGS. 4 and 5 wherein it will be seen that a center tongue **46*a* or 48*a* has been pressed away from the other two tongues 46*b* or 48*b*** that remain coplanar with the stem element of the Y. The stem element is integral with a conductor portion disposed within the respective plug-receiving aperture.

The ground terminal 50 is formed of an L-shaped piece secured to the body by a screw **50*a* which passes through a hole in the spring 40 and a hole in an insulating sheet 50*b* into threaded engagement with the body. The shank of the screw 50*a* contacts a conductor disposed within the ground aperture in the body. The free end of the terminal is provided with a longitudinal slot having a downwardly tapering portion 50*c* which merges with an enlarged portion 50*d*. When a bus wire of appropriate diameter is laid into the slot and pressed downwardly the wire is guided toward and snaps into the enlarged slot portion 50*d***.

During assembly of an outlet strip each of the outlet receptacles is snapped into its respective aperture in a preselected position such that each series of live, neutral and ground terminals lies in a predetermined pattern. Specifically, each series of like terminals lies along a path which is spaced from and does not cross the paths of the other two series, and the slots in each series face in the same longitudinal direction. In the embodiment of FIG. 1 each of the paths is straight and in the embodiment of FIG. 2 each of the paths is wave-shaped; in both embodiments the paths are parallel to each other.

During a subsequent assembly step like terminals of each series of receptacles are connected together by means of a bus wire which is laid into the slots of the terminals and then more securely attached to those terminals. In FIG. 1 the live bus wire 54, neutral bus wire 56 and ground bus wire 58 are straight and in FIG. 2 the corresponding bus wires 54', 56' and 58' are wave-shaped. Permanent connection of the live and neutral bus wires to their terminals can be effected by crimping the arms 46*a* or 48*a* toward the arms 46*b* or 48*b* or by soldering the bus wires to the arms or by crimping and then soldering. The ground bus wires when pushed into the slot portions 50*d* become entrapped therein; preferably the cross-section of the ground bus wires are the same as the area of the slot portions 50*d*. If desired the arms on either side of the slots 50 can be crimped toward each other or soldered to the ground bus wires or both.

Each live, neutral and ground bus wire may be a preshaped length of wire which is precut to an appropriate length. After connection to the appropriate terminals each bus wire must be connected to a corresponding wire in a cable 60 which enters the casing through an appropriate hole, and this may be accomplished in any convenient manner. In the case of the live and neutral bus wires the corresponding live and neutral leads 64 and 68 of the cable 60 may be soldered to one of the respective terminals 46 or 48. The ground lead 70 may be soldered to a stud 74 which is soldered to the casing, and the ground bus wire may be connected to the same stud by a wire 72. The ground lead 70 may alternatively be soldered to the ground bus wire or to one of the ground terminals, with a separate connection being made between the ground bus wire and the casing.

Altneratively the bus wires can be integral extensions of the leads 64, 68, 70. In either case the bus wires may be either bare or insulated, provided that the insulation when present is removed at the points of connection between wire and terminals. When the spread apart arms of the exposed ends of the terminal elements 46, 48 and 50 all face the open side of the box 10, the respective bus wires whether integral with conductor 60 or formed separately therefrom can be easily placed between the open arms. Because the arms are all aligned in a predetermined pattern, it is seen that the valleys between all the arms of all the shaped elements are in a fixed pattern or alignment and the ease with which the bus wires may be integrated with their respective terminals, is apparent. Also the performance of the soldering or crimping step or steps is or are likewise facilitated because of the disposition of the open arms of all of the shaped terminals that are exposed in a fixed pattern facing the open side of the casing 10.

It will be noted that the stem portions of the roughly Y-shaped hot and neutral terminals 46 and 48 are turned flatwise to the side walls 14 and 15 of the casing while the longer dimension of the stem portion of the ground terminal 50 is disposed at right angles to these side walls. Because of the positioning of these terminal elements in the insulating bodies in this manner, the slightly different manner of forming the shaped elements 46 and 48 vis-a-vis 50 has been shown. The slitting of the end of terminals 46 and 48 permits arms to be formed on those terminals that form a roughly Y-shape, which can be aligned with the preshaped bus wire to form a receiving slot. The wire receiving slot produced in terminals 50 by a simple die pressing operation likewise is well adapted to receive a preshaped bus wire. It is, however, to be understood that other similarly shaped bodies having spread apart arms to first receive and then be crimped or soldered or crimped and soldered onto a bus bar can be formed in other ways that will serve the purposes of this invention. While it is preferred that the valleys between the arms of the respective hot, neutral and ground terminals be generally aligned, this is not an absolute requirement, since the bus wires that are manipulated through the open side of the casing to be laid between and supported on the arms of the shaped terminals, could be shaped to fit other prearranged fixed patterns of the spread apart arms of the cooperating shaped terminal means.

Because the open arms of the shaped terminals all face the open side of the casing 10, all the steps of placing the bus wires, completing the ground circuit, soldering and crimping the arms of the terminals, can be completed quite easily. The elements are accessible through the open side of the casing and the assembling operations can be fitted to relatively simple automated tooling without undue complications.

Once the bus wires and terminals have been electrically connected together and to the cable 60 as above described, a cover may be fastened in place and the outlet strip is ready for use. An assembly can be made by following this invention with any number of outlet receptacles connected in parallel.

The above is a description of the preferred form of this invention, it is possible, however, that modifications of the structure and method of assembly here shown may occur to those skilled in the art that will fall within the scope of the following claims.

What is claimed is:

1. In combination a casing and at least two electrical outlet receptacles, said receptacles all having live, neutral and ground terminals, all of the respective live, neutral and ground terminals of said receptacles being adapted to be connected into a parallel circuit, said casing having a bottom with a corresponding number of apertures therein to receive said receptacles, and side and end walls to enclose a space therein into which said receptacles extend from said bottom, the casing having an open side opposite said bottom, there being a cover to complete the enclosure of the space inside the casing, said receptacles being formed of an insulating body for supporting said terminals and having openings on one side that are exposed on the outside of the casing for receiving two and three pronged electrical plugs for connection to said terminals, a three wire conductor for carrying an electrical current to said casing, said conductor having live, neutral and ground leads, means for supporting each of said live, neutral and ground terminal elements on said insulating bodies to extend beyond said bodies into said space in the casing so that said terminals are arranged in the same spaced apart positions one relative to the other on each of said insulating bodies and so that said ground terminal is intermediate said live and neutral terminals, said insulating bodies being fitted into said bottom apertures of the casing with said openings for the plugs exposed to the outside of said casing, said insulating bodies being arranged in said apertures with like terminals of one kind adjacent one wall, like terminals of a second kind adjacent a wall opposite said one wall, and like ground terminals being positioned in said space between said live and neutral terminals, all of said terminals being formed in a shape with spread apart arms, all of said terminals at the junctions of the spread apart arms being separated from one another by a relatively open and unobstructed space into which no significant part of said insulating body extends and all of said terminals being supported in said space with the open arms facing said open side of the casing, there being three separate bus wires adapted to be individually fitted between and attached to the open arms of the respective live, neutral and ground terminals when the cover of the casing is removed, said live and neutral terminals respectively being electrically connected to the live and neutral leads of said conductor and said ground lead having an electrical connection with the interconnected ground terminals and said casing.

2. A structure as in claim 1 wherein said respective bus wires are soldered to the respective terminals after being dropped into place between the arms of said shaped terminals.

3. A structure as in claim 1 wherein the arms of said respective terminals are squeezed crimped closed over the respective bus wires after they have been dropped in place.

4. A structure as in claim 3 wherein the bus wires are soldered to said squeezed and crimped arms.

5. A structure as recited in claim 1 wherein said live, neutral and ground terminal elements of each receptacle are disposed at the apexes of an imaginary triangle.

6. A snap-in electrical outlet receptacle comprising:

an electrically insulating body including a flat front face provided with three apertures for receiving three prongs of an electrical plug, said body also including a rear face spaced from and generally parallel to said front face and side walls between said front and rear faces;

at least one resilient snap-in member carried by the body and protruding from a side wall thereof, said resilient member being resiliently displaceable in a direction generally parallel to said front face so as to be capable of releasably holding the receptacle within an aperture in an electrical component;

a middle and two end terminals comprising three electrically conducting terminals having free end portions protruding from said rear face and arranged at the apexes of an imaginary triangle, said end portions defining quick-connect, wire-receiving, open-end slots arranged such that a wire laid in each slot lies parallel to and spaced from wires laid in the two other slots and parallel to and spaced from said rear face; and each of said terminals being formed from a metal strip having a width dimension substantially greater than its thickness dimension, said strips of said end terminals having their width dimensions disposed in different parallel planes and said strip of said middle terminal having its width dimension disposed in a plane transverse to said parallel planes, each of said strips of said end terminals having a tongue pressed therefrom so as to define the respective slot between the tongue and the remainder of the strip and said strip of said middle terminal having a cut-out through the thickness dimension so as to define the slot in said middle terminal strip.

7. A method of assembling a series of electrical outlet receptacles in a grounded outlet strip utilizing a casing having an apertured bottom and an open top, each receptacle having live neutral, and ground terminals extending outwardly therefrom, with the ground terminal disposed between the live and neutral terminals, and each terminal having spread apart arms at one end thereof, said method consisting of the steps of sequentially inserting receptacles in the apertures in the casing bottom so that all of the terminals of the receptacles are arranged in a patterned spaced relationship with the spread apart arms thereof facing toward the casing open top with all of the arms of the respective live, neutral, and ground terminals disposed in paths that are parallel to each other, all of said terminals at the junctions of the spread apart arms being separated from one another by a relatively open and unobstructed space into which no significant part of said insulating body extends, providing mechanical security for bus wires by preliminarily fitting separate bus wires through the casing open top into the respective sets of terminals between their open arms so that the bus wires are held by the open arms, with a ground bus wire disposed between parallel live and neutral bus wires, positively mechanically and electrically securing the separate fitted bus wires to their respective terminals, mounting a three-wire conductor to the casing, and operatively connecting the three-wire conductor to the terminals so that live current is supplied to the live terminal and so that separate leads are provided for the neutral and ground terminals, and placing a cover over the open top of the casing, and securing the cover to the casing.

8. A method as recited in claim 7 wherein the terminal arms face upwardly, and wherein said step of providing mechanical security is accomplished by lowering the bus wires into place between the upwardly facing terminal elements.

9. A method as recited in claim 7 wherein said step of positively mechanically and electrically securing the fitted bus wires to their respective terminals is accomplished by soldering the bus wires to the terminals.

10. A method as recited in claim 9 wherein said positively securing step is further accomplished by crimping said terminals onto the respective bus wires before soldering.

11. A method as recited in claim 7 wherein said positively securing step is accomplished by crimping said terminals onto the respective bus wires.

* * * * *